United States Patent [19]

Schwarzmann

[11] 4,250,475

[45] Feb. 10, 1981

[54] ADJUSTABLE PASSBAND FILTER

[75] Inventor: Alfred Schwarzmann, Mt. Laurel, N.J.

[73] Assignee: RCA Corporation, New York, N.Y.

[21] Appl. No.: 35,070

[22] Filed: May 1, 1979

[51] Int. Cl.[3] ..... H01P 1/20; H01P 3/08

[52] U.S. Cl. ..... 333/205; 333/204

[58] Field of Search ..... 333/204, 205, 164, 161, 333/115, 116, 207, 209, 202

[56] References Cited

U.S. PATENT DOCUMENTS

| | | | |
|---|---|---|---|
| 3,414,833 | 12/1968 | Tolliver | 334/41 |
| 3,417,351 | 12/1968 | DiPiazza | 333/205 |
| 3,605,045 | 9/1971 | Ramsbotham | 333/204 |

*Primary Examiner*—Alfred E. Smith
*Assistant Examiner*—Thomas P. O'Hare
*Attorney, Agent, or Firm*—Samuel Cohen; Robert L. Troike

[57] ABSTRACT

An adjustable passband filter comprises at least one reentrant section in shunt with a transmission line, which section can be electronically switched between different conditions. The reentrant section, when in at least one condition acts, to reduce the band of frequencies passed by the transmission line by increasing the effective capacitance of the filter and when in another condition, operates as an open circuit, whereby the filter exhibits a broader passband.

10 Claims, 4 Drawing Figures

ADJUSTABLE PASSBAND FILTER

The present invention generally relates to adjustable passband filters and, in particular, relates to an adjustable microstrip reentrant passband filter.

A desirable feature of many electronic systems, particularly microwave radar surveillance systems, is the ability initially to sample the frequency components present in a broad frequency band and if a signal of interest is found, to narrow the frequency band being sampled. The purpose of narrowing the sampled bandwidth is to reduce the received noise, thereby increasing the signal-to-noise ratio.

The signal seeking portion of a surveillance system such as discussed above may include strip transmission line filters either of the quarter-wavelength stub type or of the parallel-coupled type. Conventionally, the bandwidths of such filters are fixed. For example, as shown in U.S. Pat. No. 3,605,045 issued on Sept. 14, 1971, to Ramsbotham, the circuit is constructed for a particular bandwidth with respect to a given resonant wavelength. Once such a filter is designed and fabricated, the bandwidth thereof for that particular resonant wavelength is fixed.

The present invention generally relates to adjustable passband filters and, in particular, relates to a transmission line filter having a reentrant network. The reentrant network can be switched into a condition where it appears like a substantial value of capacitance load in the filter.

In the drawing, which is not to scale:

Figure 1:
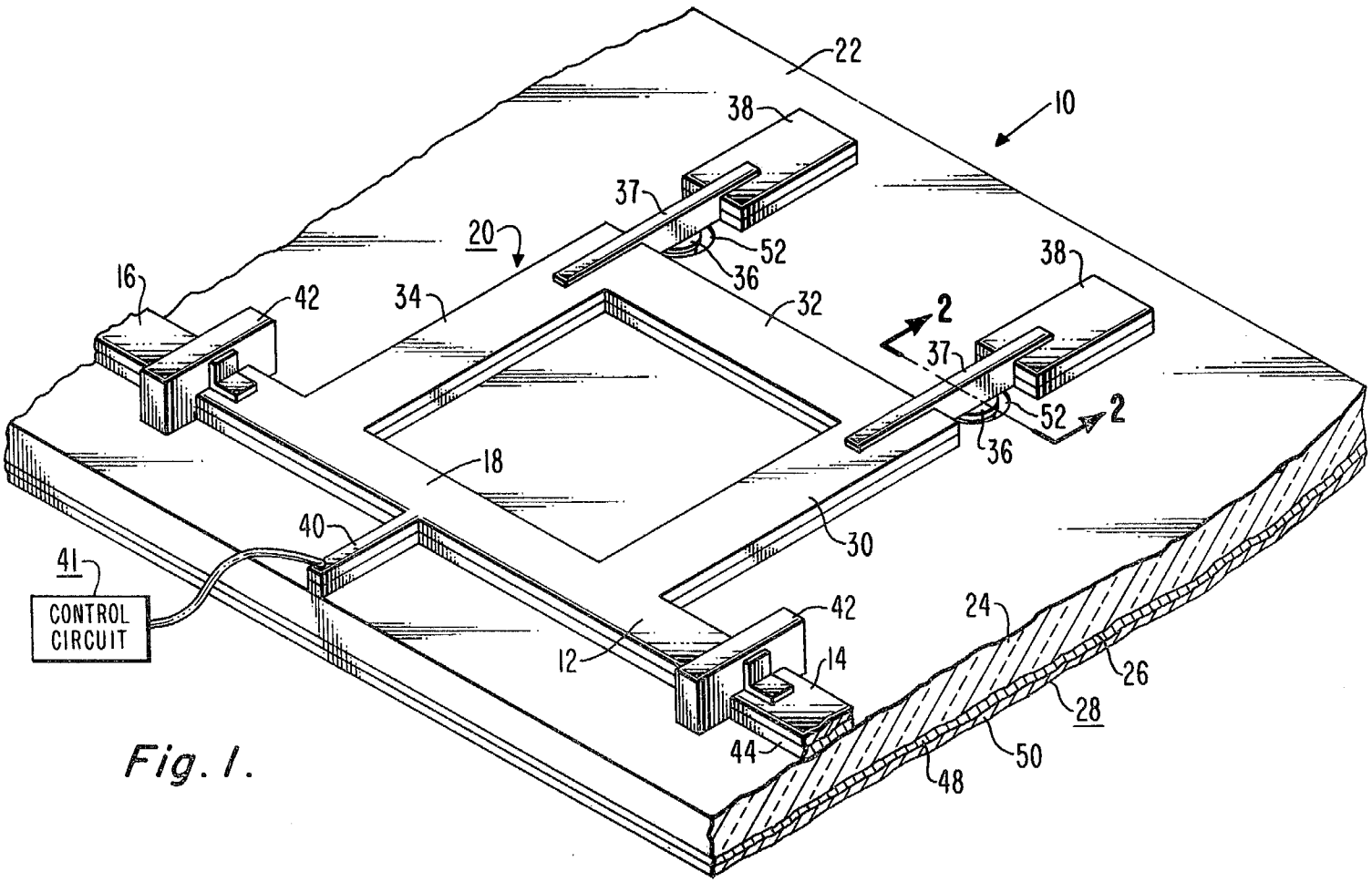
FIG. 1 is a partial perspective view of a first filter having a single reentrant section, embodying the principles of the present invention.

Referring to FIG. 1, the passband filter 10 is shown in microstrip form, although it could instead be fabricated utilizing coaxial cables, waveguide, or the like. The filter 10 includes a main transmission line 12 having an input section of transmission line 14 and a second section of transmission line 16 which may serve as an output section. It also includes a third section 18 of main transmission line 12 coupling the input section 14 and the second section 16. In addition, the filter 10 includes a reentrant network 20 which can be electronically switched into or out of the main transmission line 12. The reentrant network 20 is coupled between the input section 14 and the second section 16 of the main transmission line 12, that is, it is in shunt with the third section 18. The main transmission line 12 and the reentrant network 20 are formed on one surface 22 of an electrically insulating substrate 24 and a layer of conductive material serving as a ground plane 28 is formed on the opposite, parallel surface 26 of the substrate 24.

Figure 2:
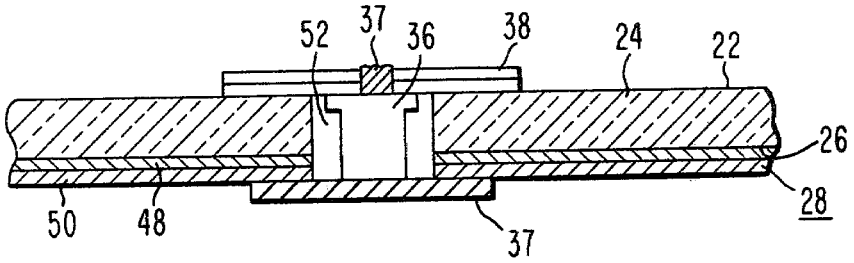
FIG. 2 is a partial cross-sectional view of a portion of the first filter shown in FIG. 1 taken along the line 2—2 thereof.

The reentrant network 20 comprises first, second and third transmission paths, 30, 32 and 34 and a pair of diodes 36 which preferably are matched diodes. The diodes are similarly mounted and FIG. 2 shows some of the structural details. Referring to FIG. 2, diode 36 is located in an opening 52 in substrate 24 and is connected at one of its electrodes to the ground plane 28 by means of a conductor such as gold strip 37. The diode is connected at its other electrode to the end of the first transmission path 30 and to one end of transmission line section 38 which is discussed later. The other diode 36 is located in another opening 52 in the substrate and is connected in similar fashion at one electrode to the ground plane 28 and at the other electrode to the proximate ends of transmission line sections 34 and 38. The diodes 36 are preferably poled in the same way, that is, either both anodes are connected to the ground plane 28 and both cathodes to the ends of the transmission paths 30 and 34 respectively or vice-versa.

In one practical design of the embodiment of FIG. 1, the main transmission line 12 has an impedance of about 50 ohms which is the industry standard for microwave microstrip circuits. Preferably, but not necessarily, the reentrant network 20 comprises three transmission paths, 30, 32 and 34, the first 30 and the third 34 of which are substantially parallel to each other and substantially perpendicular to the main transmission line 12 and electrically connected to that main transmission line 12. The second transmission path 32 of the reentrant network 20 is shown substantially parallel to the main transmission line 12 and is electrically connected at its opposite ends to the end portions of the first and third transmission paths 30 and 34, respectively. Preferably, although not necessarily, the impedance of the second transmission path 32 is about 50 ohms whereas the impedance of the first and third transmission paths 30 and 34 respectively, while preferably equal to each other, are determined from the formula;

$$Z_{1,3} = \sqrt{\frac{Z_m Z_2}{2}}$$

wherein $Z_{1,3}$ = the impedance of the first and third legs $Z_m$ = the impedance of the main transmission line; and $Z_2$ = the impedance of the second leg As readily determined for a $Z_m = 50\Omega$ and $Z_m = Z_2$, equaling $Z_{1,3} = 35\Omega$.

The reason for selecting the impedances of the transmissions paths 30, 32 and 34 of the reentrant network 20 according to the above formula is to ensure that the reentrant network 20, in combination with the third section 18 of transmission line, exhibit an impedance of 50 ohms to the main transmission line 12 so that the entire filter 10 is matched. By being matched the reflected energy at the input section 14 of the filter 10 is minimized when externally connected to any other 50 ohm system. It should be noted that to reduce the amount of energy reflected from the reentrant network 20 to the main transmission line 12 the first and third transmission paths 30 and 34 respectively should be about a quarter wavelength of the center frequency of the filter long and should be spaced from one another by about the same amount. In general, the quarter wave-length mentioned above, as well as any other length measurements required, are measured from the center of the microstrip transmission lines.

In order to reduce the amount of energy reflected at the input section 14, the length of the path through 30, 32 and 34 should exceed that of the third section 18 of transmission line bridging the first 30 and third 34 transmission paths by one half wavelength of the center frequency of the filter or some odd multiple thereof. Therefore, the total length of the first plus the third transmission paths 30 and 34 should be one half wavelength or some odd integer multiple thereof.

The diodes 36 are preferably PIN diodes although almost any diode can be used. For example, one particular PIN diode, the MA474000 device manufactured and marketed by Microwave Associates of Burlington, Massachusetts has been found to be especially useful. One reason that the diodes are particularly useful is that in the open state they exhibit a capacitance which is on the order of about 0.9 picofarads while in the shorted state they represent a resistance on the order of about one ohm and an inductance of about 0.001 microhenry. Alternatively, as more fully discussed below, a varactor having a continuously voltage variable capacitance can be used.

The reentrant circuit 10 can optionally include line lengths 38 which extend beyond the diodes 36 and which, when the diodes 36 are open with respect to ground, operate as lines which are electrically connected to the first and third transmission paths 30 and 34, respectively. The connection between a line length such as 38, a transmission path 30, and a diode 36 may be via a conductive strip 37 using a bonding technique such as thermocompression bonding. The line lengths 38 are for the purpose of introducing additional capacitance change in the reentrant circuit 10 when the diodes 36 are open. Preferably the line lengths 38 are less than $\lambda/8$ long and are made as wide as needed to provide the particular capacitance desired. The relationship between the effective capacitance of a line length and its area is sufficiently well known that it need not be discussed.

In addition to the above elements, the filter 10, according to the precepts of the present invention, also contains a D.C. bias line 40 which is shown connected to the main transmission line 12. Means 41 for controlling the state of the diodes 36 is electrically connected to the D.C. bias line. Such a means 41 may include a regulated power supply which is capable of providing a D.C. voltage at two different levels, one for forward biasing the diodes and causing them to operate as short circuits and the other level for reverse biasing the diodes for causing them to operate as open circuits. The D.C. voltage is isolated from paths 14 and 16 by blocking capacitors 42 connected between the respective ends of these paths and the third section 18.

By way of example, a filter circuit 10 such as illustrated, having a preselected center frequency ($f0$) of about 3 GHz may be formed on a substrate 24 of alumina ($Al_2O_3$) having a thickness on the order of about 0.13 centimeters. The main transmission line 12 and the reentrant network 20 may be formed of a layer 44 of molybdenum about 200 Å thick in contact with the substrate and a second layer 46 of gold about 13 micrometers thick on the layer of molybdenum. The width of the main transmission line 12 is about 0.12 cm to yield an impedance of about 50 ohms. The first and third transmission paths 30 and 34 respectively of the reentrant network 20, in this instance, are about 0.23 centimeters wide and have an impedance of about 35 ohms. The second transmission path 32, as discussed above, has about the same impedance as the main transmission line 12 and is thus about 0.12 centimeters wide.

The ground plane 28 comprises two layers, one layer 48 of molybdenum and the other layer 50 of gold thereon each having about the same thickness as their counterpart layers 44 and 46 respectively, on the first surface 22. Preferably, substantially all of the second surface 26 has the ground plane 28 thereon. As well known in the art, the ground plane of a microstrip circuit is functionally similar to the outside metal sheathing of a coaxial transmission line.

The adjustable passband filter 10 described above can be viewed as having two operating states. In the first operating state, both diodes 36 are forward biased and operate as short circuits, that is, each operates as a low impedance between a line (30 and 34) and the ground plane. In such a case, because the first and third transmission paths 30 and 34 respectively are a quarter-wavelength long, any energy entering these transmission paths 30 and 34 is effectively completely reflected and returned to the main transmission line 12 as if both transmission paths 30 and 34 were not present. Thus, substantially all of the energy entering the main transmission line 12 at the input section 14 is propagated to the second section 16. Further, when the diodes 36 are both on and operating as short circuits, there is negligible energy stored in the second transmission path 32 of the reentrant network 20.

In the second operating state both diodes 36 are reverse-biased and operate as open circuits and in this condition the second transmission path 32 of the reentrant network 20 is effectively included in the circuit. In this state of the circuit, the reentrant network 20 "looks" to the transmission line 18 like a capacitance which is made up of the capacitance of the diodes 36 themselves, the capacitance between the second transmission path 32 and the ground plane, effectively forms a capacitor, and the capacitance of any optional line lengths 38 beyond the diodes 36. In this state, the second transmission path 32 and any optional line lengths present store energy much like a capacitor. The fact that increased storage capacitance reduces the bandwidth of a circuit can be understood by recognizing that $B \alpha L/C$; where B is the bandwidth of a circuit centering around a center frequency $f_0$; L is the circuit inductance and C is the circuit capacitance. When the diodes 36 are open and the circuit capacitance is increased the bandwidth is decreased. From the above description it can be readily observed that the reentrant network 20 and the associated diodes 36 thereof represent an adjustable passband filter 10.

As mentioned above, varactor diodes can be used in the reentrant network 20 in place of the PIN diodes previously discussed. When varactor diodes are utilized instead of PIN diodes, the passband filter 10 becomes continuously tunable rather than stepwise tunable. This results from the fact that the effective capacitance presented to the circuit by a varactor can be continuously adjusted whereas, as a practical matter, a PIN diode can only operate in one of two states.

Figure 3:
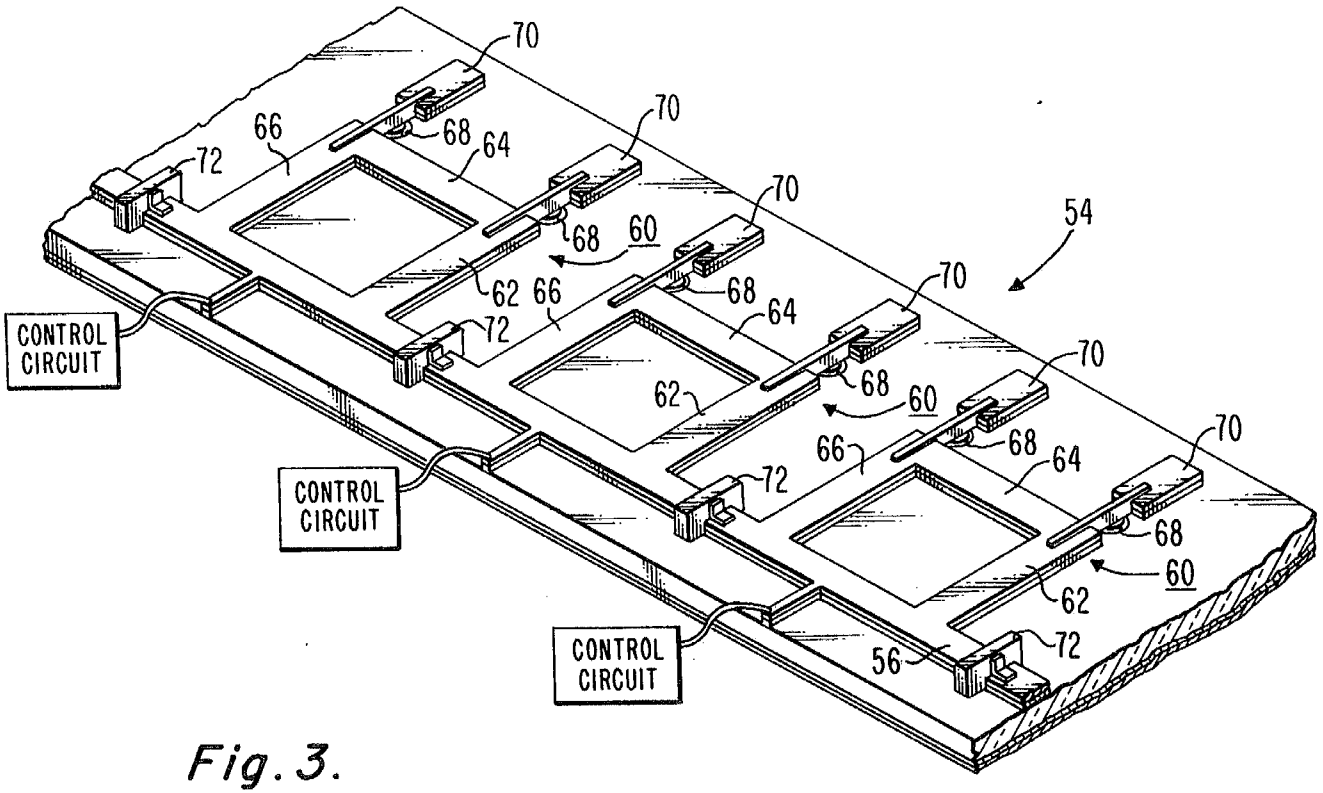
FIG. 3 is a partial perspective view of another filter having a plurality of reentrant sections embodying the principles of the present invention.

Referring now to FIG. 3 which illustrates a second embodiment of the invention, filter 54 is depicted having a single main transmission line 56 having connected thereto a plurality of reentrant networks 60. As with the filter 10 shown in FIG. 1, each reentrant network 60 of the embodiment shown in FIG. 3 comprises first, second and third transmission paths 62, 64, 66 respectively with a pair of diodes 60 similarly positioned and optional line lengths 70 to provide additional capacitances. In this embodiment, each reentrant network 60 is separated from each other reentrant network 60 by a D.C. blocking capacitor 72 so that each reentrant network can be separately controlled.

The introduction of a plurality of reentrant networks 60 results in a cumulative effect on the overall bandwidth of the main transmission line 56. That is, for example, if each pair of diodes 68 for each network 60 is shorted, the bandwidth of the filter is effectively equal to the bandwidth of the main transmission line 56. If, for instance, one of the pair of diodes 68 associated with one of the networks 60 is switched from a shorted state to an open state, to effectively introduce that network 60 into the main transmission line 56, the bandwidth of the filter 54 is reduced. When a second reentrant network 60 is switched into the main transmission line 56, regardless of which reentrant network 60 is chosen, the effect is to further reduce the bandwidth of the filter 54, and so on.

Figure 4:
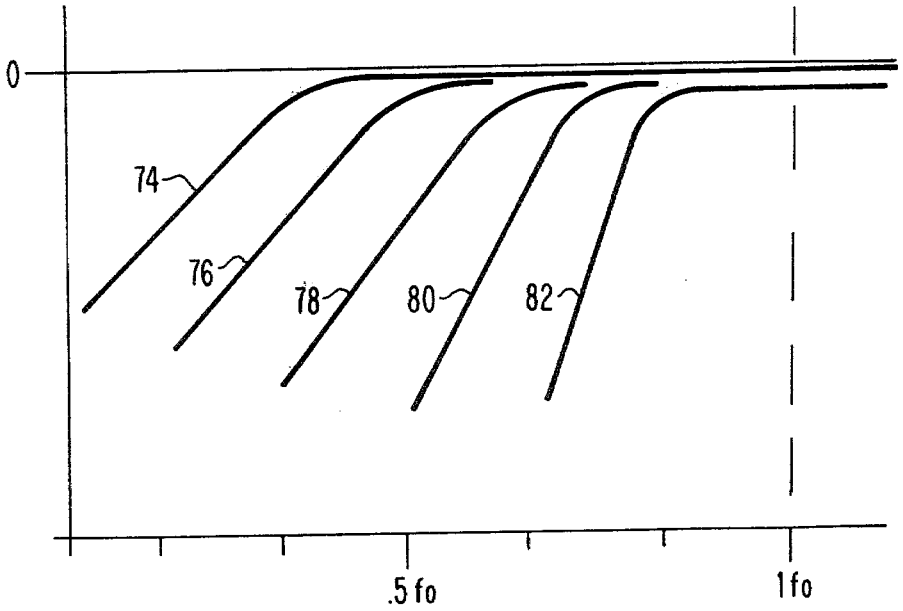
FIG. 4 is a graphic representation of the bandwidth response of a filter made according to the principles of the present invention.

The above described relationship is graphically illustrated in FIG. 4 which shows a relatively wide bandwidth response curve 74 which represents the bandwidth response of the main transmission line 56 without any reentrant networks 60 in the path thereof. The curve indicated at 76 represents the bandwidth response of the filter 54 having a single reentrant network 60 in the main transmission line 56. The curve 78, which shows a narrower bandwidth response than the line 76 represents the bandwidth response wherein two of the reentrant networks 60 are switched into the filter 54. Likewise the curves 80 and 82 represent the condition wherein three and four, respectively, reentrant network 60 are switched into the filter 54.

It will be understood that the impedance of the second transmission path 64 of each network 60 does not have to be equal to the impedance of the main transmission line 56 but also that the impedance of the second transmission path 64 does not have to be the same for each of a plurality of reentrant networks 60 connected to the same main transmission line 56. That is, the impedance of each second transmission path 64 is independent of each other second transmission path 64.

The adjustable passband filters, 10 and 54, described herein have a variety of uses. In particular, such filters 10 and 54 can enhance a heterodyne receiver and yet provide such a system with the ability to sample a broad bandwidth response and subsequently narrow the bandwidth thereof to improve the signal-to-noise-ratio at the output.

What is claimed is:

1. An adjustable passband transmission line filter having a preselected substantially fixed center frequency comprising, in combination:

an input section of transmission line to which a signal to be filtered may be applied;

a second section of transmission line; and a network coupled between said input and said second sections, said network comprising:

a third section of transmission line matched in impedance to the input and second sections and coupling said input section to said second section;

a reentrant transmission line network in shunt with said third section of transmission line; said reentrant transmission line network comprising first, second and third transmission paths connected in series with one another in the order named, said first and said third transmission paths being connected at one end to spaced points along said third section, and at their other end to opposite ends of said second path, said first, second and third paths and said third section each having a length of substantially $n\lambda/4$ where n is an odd integer and $\lambda$ is the wavelength of said center frequency; and means including first and second controllable switching devices connected between said other end of said first and third paths, respectively, and a point of reference potential for switching said reentrant transmission line network between a first condition in which said reentrant transmission line network appears like an open circuit to said third section whereby said filter passes a first band of frequencies centered at said fixed center frequency and a second condition in which said reentrant transmission line network appears like a substantial value of capacitance load on said third section whereby said filter passes a second relatively narrower band of frequencies centered at said fixed center frequency.

2. A filter as claimed in claim 1, wherein said switching devices are diodes which are poled in the same direction.

3. A filter as claimed in claim 2 wherein said diodes comprise PIN diodes.

4. A filter as claimed in claim 2 wherein said diodes comprise varactor diodes.

5. A filter as claimed in claim 1 wherein said second path has a length of $\lambda/4$.

6. An adjustable passband transmission line filter as claimed in claim 1 wherein said switching means comprises:

a first diode connected between said other end of said first transmission path and ground;

a second diode connected between said other end of said third transmission path and ground; and means for concurrently controlling the operating states of said diodes so that both of said diodes are in the same operating state.

7. An adjustable passband transmission line filter as claimed in claim 6 further comprising:

a first line length connected to said other end of said first transmission path; and a second line length connected to said other end of said third transmission path, whereby when first and second diodes are placed in a cut-off condition, said first and second line lengths increase the capacitance of said reentrant network.

8. An adjustable passband transmission line filter as claimed in claim 1 wherein:

said input and said second section of transmission line have a preselected impedance; and said second transmission path has an impedance substantially equal to said impedance of said input and said second section of transmission line.

9. An adjustable passband transmission line filter as claimed in claim 1 wherein said filter comprises:

a plurality of said networks.

10. An adjustable passband transmission line filter as claimed in claims 1 or 9 wherein:

said filter is a microstrip circuit.

* * * * *